United States Patent [19]

Gurries

[11] Patent Number: 4,821,808

[45] Date of Patent: Apr. 18, 1989

[54] RESONANTLY DRIVEN EARTH MOVING BLADE

[75] Inventor: Raymond A. Gurries, Reno, Nev.

[73] Assignee: Resonant Technology Company, Reno, Nev.

[21] Appl. No.: 152,286

[22] Filed: Feb. 4, 1988

[51] Int. Cl.[4] ..... E02F 3/815

[52] U.S. Cl. ..... 172/40; 172/811; 172/701.3

[58] Field of Search ..... 172/40, 811, 701.1, 172/701.3; 37/DIG. 18

[56] References Cited

U.S. PATENT DOCUMENTS

| | | | |
|---|---|---|---|
| 2,690,902 | 10/1954 | Ream | 172/40 |
| 3,145,488 | 8/1964 | French | 37/141 |
| 3,238,646 | 3/1966 | Oldenburg | 37/141 |
| 3,328,904 | 7/1967 | Voigt et al. | 37/142 |
| 3,367,716 | 2/1968 | Bodine | 299/14 |
| 3,392,464 | 7/1968 | MacDonald | 37/101 |
| 3,443,327 | 5/1969 | Martin | 37/126 |
| 3,478,450 | 11/1969 | Cunningham | 37/141 |
| 3,628,265 | 12/1971 | Galis | 37/126 A |
| 3,645,021 | 2/1972 | Sonerud | 37/141 |
| 3,762,481 | 10/1973 | Allen | 172/40 |
| 3,770,322 | 11/1973 | Cobb et al. | 299/37 |
| 3,795,070 | 3/1974 | Bronson et al. | 37/117.5 |
| 3,867,987 | 2/1975 | Seaberg | 172/40 |
| 4,229,045 | 10/1980 | Gurries | 299/37 |
| 4,310,054 | 1/1982 | Gurries | 172/40 |
| 4,359,102 | 11/1982 | Gurries | 172/40 |
| 4,467,539 | 8/1984 | Gurries | 172/40 |
| 4,611,667 | 9/1986 | Tharp | 172/40 |

FOREIGN PATENT DOCUMENTS

| | | | |
|---|---|---|---|
| 971580 | 7/1975 | Canada | 262/62 |
| 1104429 | 4/1961 | Fed. Rep. of Germany . | |
| 1484663 | 3/1969 | Fed. Rep. of Germany . | |
| 149003 | 10/1921 | United Kingdom . | |

OTHER PUBLICATIONS

Automotive Engineering, Nov. 1978, "Bulldozer Blade Oscillation", pp. 74–80.

Society of Automotive Engineers, Technical Paper Series, 780776, "Soil Excavation Improvement from Bulldozer Blade Oscillation", Joseph M. Brown, pp. 1–18, Off-Highway Vehicle Meeting & Exposition MECCA, Milwaukee, Sep. 11–14, 1978.

*Primary Examiner*—Richard J. Johnson

*Attorney, Agent, or Firm*—Townsend and Townsend

[57] ABSTRACT

An improved version of applicant's prior bulldozer mold board assemblies is disclosed. Such prior assemblies include a mold board, a reciprocating cutter blade along the lower edge of the mold board, and a resonant beam mounted aft of the mold board.

The vibration of the beam results in a reciprocating force at the node, which is undesirable in applicant's prior device. The present invention improves on applicant's former construction by pivotably supporting the mold board so that the mold board is pivotable about a transverse axis. The resonant beam is connected at its central node to the mold board. In this fashion, the reciprocating transverse forces on the node of the resonant beam are transmitted to the pivotably mounted mold board to agitate the material in contact therewith.

28 Claims, 3 Drawing Sheets

RESONANTLY DRIVEN EARTH MOVING BLADE

BACKGROUND OF THE INVENTION

This application relates to a mold board assembly in which the mold board is resonantly driven to both cut and agitate the material to be moved. In this context the term "mold board" includes both the type of mold board used in a bulldozer and a shovel used in a front end loader.

Applicant's U.S. Pat. No. 4,359,102 shows bulldozer having a reciprocating cutter blade at the base of the mold board. A resonant beam drives the cutter blade intermittently forwardly to cut the material to be dozed. This bulldozer construction has been found to be quite useful because it loosens the earth to be moved by the bulldozer, substantially reducing the force that must be applied to dislodge the earth and the size of the tractor needed to advance the mold board. However, this construction still is not as efficient as desired, because the earth and other material, once dislodged by the cutter, remains compacted together and is difficult to move.

Various prior devices have attempted to break up the earth and make it easier to move. U.S. Pat. No. 3,443,327 shows a front end loader with a shaker for vibrating the entire shovel. U.S. Pat. No. 3,770,322, particularly FIGS. 25 and 26, shows a mold board which is shaken by an oscillator. U.S. Pat. No. 3,367,716, particularly FIG. 22, shows a similar arrangement. Unfortunately, these devices provide immense stresses on the mold board, and vibrate the overall system, making them impractical. Also, such devices in effect combine the cutting and agitation functions, and have been found not to be as effective as desired for either task.

SUMMARY OF THE INVENTION

The present invention provides an improved version of applicant's prior bulldozer mold board assemblies. Such prior assemblies include a mold board, a reciprocating cutter blade along the lower edge of the mold board, and a resonant beam mounted aft of the mold board. The resonant beam has an input end, a central node and a force transmitting end proximate the cutter blade. An oscillator is located at the input end of the beam to vibrate the resonant beam near the resonant frequency. With this construction, the force transmitting end of the resonant beam drives the cutter blade intermittently forwardly into the material to be cut.

The vibration of the beam results in a reciprocating force at the node, which is undesirable in applicant's prior device. The present invention improves on applicant's former construction by pivotably supporting the mold board so that the mold board is pivotable about a transverse axis. The resonant beam is connected at its central node to the mold board. In this fashion, the reciprocating transverse forces on the node of the resonant beam are transmitted to the pivotably mounted mold board to agitate the material in contact therewith.

The present invention provides a unique construction which retains all of the advantages of having a cutter blade separate from the mold board which reciprocates to cut the earth to be moved. Using the same resonant beam that drives the cutter blade, the mold board itself is separately and independently agitated, thus fluidizing the material dislodged by the cutter blade. This relatively straightforward construction both cuts the material loose and fluidizes the material, rendering it much easier to move. As a result, a relatively small bulldozer can be used to efficiently move large amounts of material.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
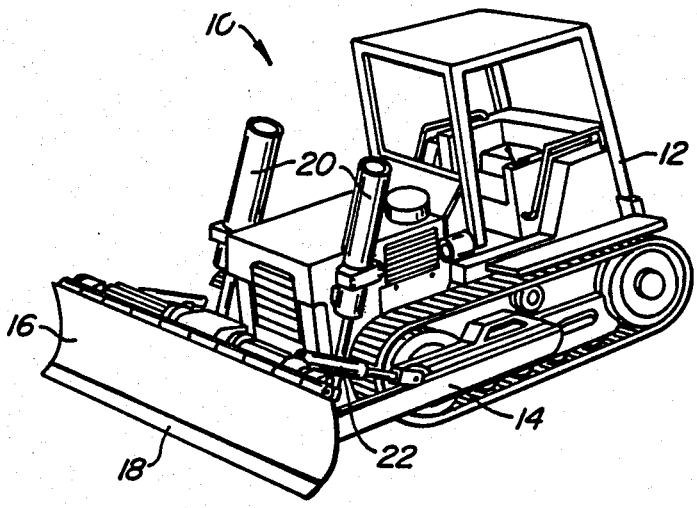
FIG. 1 is a perspective view of a bulldozer incorporating a preferred embodiment of the present invention.

Referring initially to FIG. 1, a bulldozer 10 incorporating a preferred embodiment of the present invention includes a conventional tractor 12 having a pair of beams 14 for operating a mold board 16. A cutter blade 18 is located along the bottom edge of mold board 16. Mold board 16 and cutter blade 18 are manipulated using a pair of lift cylinders 20, and a tilt cylinder 22.

Figure 2:
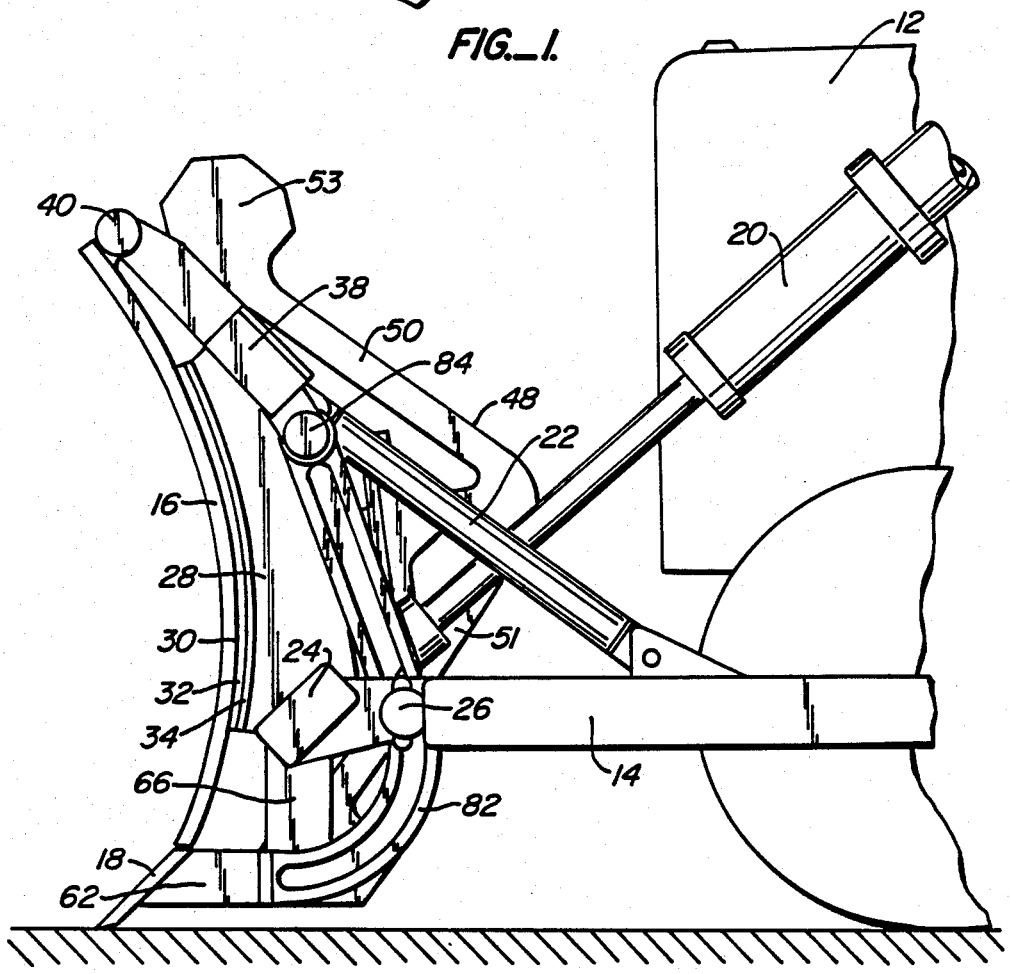
FIG. 2 is a side elevation view of the mold board assembly of the embodiment of FIG. 1.

Referring in addition to FIG. 2, beams 14 are connected to a transverse box beam 24 by a pin connection 26. Box beam 24 is part of a rigid frame which also includes a plurality of vertical ribs 28, each of which has a curved front surface 30 conformed to the shape of the back side of mold board 16. In the preferred embodiment shown, surface 30 is formed by a transverse pad 32 attached to a flange 34 on the front surface of each rib 28. Each pad 32 is approximately 3–6 inches wide.

Figure 3:
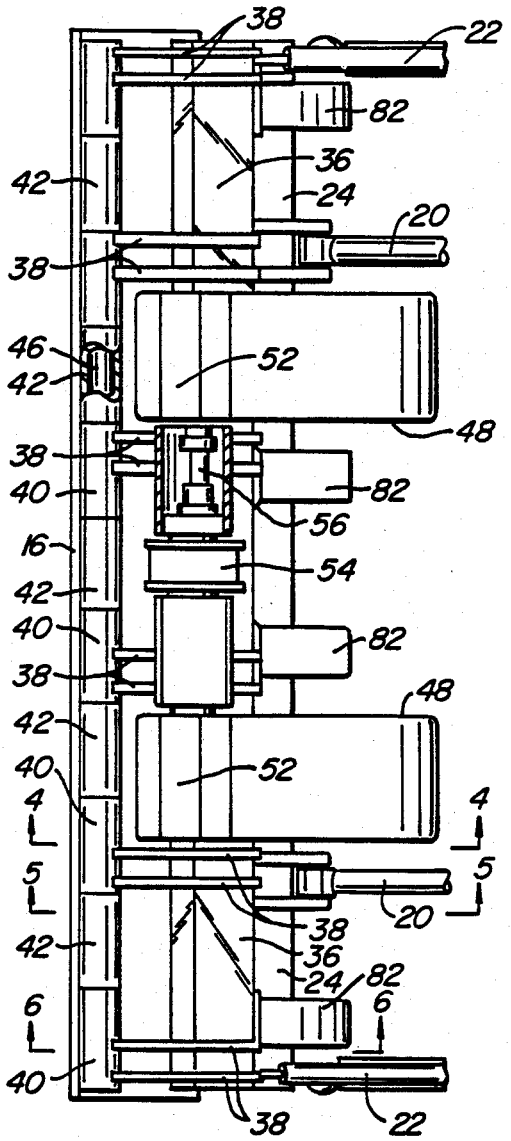
FIG. 3 is a top view of the mold board assembly of FIG. 2.
Figure 5:
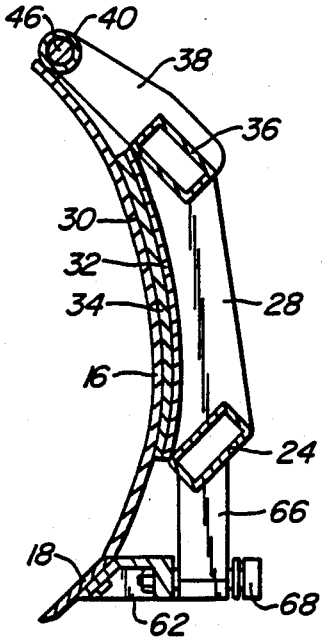
FIG. 5 is a section view taken along lines 5—5 of FIG. 3 and showing the frame support for the mold board and cutter blade.

Referring to FIGS. 2, 3 and 5, a second transverse box beam spans the top ends of ribs 28. Box beams 24 and 36 are welded to ribs 28 to form a rigid frame assembly In addition, arms 38 are welded to cross pieces 36 and extended upwardly and forwardly. A cylindrical sleeve 40 is welded to the top end of each arm 38. A plurality of cylinders 42 complementary to cylinders 30 are welded along the upper edge of the mold board 16. A pin 46 extends through the complementary sleeves 40, 42 to suspend mold board 16 from the top of the frame.

Figure 4:
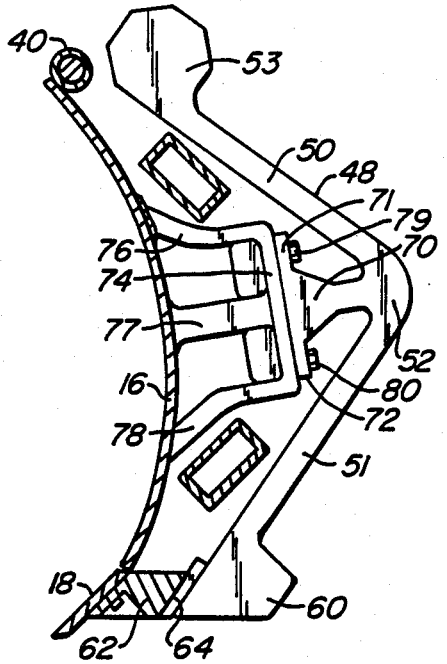
FIG. 4 is a section view taken along lines 4—4 of FIG. 3 and showing the attachment of the resonant beam.

As illustrated in FIG. 4, resonant beams 48 each include a pair of legs 50, 51 joined at a central juncture 52. Leg 50 has an input end 53 which houses an oscillator.

The oscillator is driven by a motor 54 coupled to the oscillator by a universal assembly 56. When motor 54 drives the oscillator at near the resonant frequency of beam 48, it vibrates in a near resonant mode (i.e., close to resonance but not so close as to cause structural damage to the beam). with its node at the central juncture 52 and antinodes at the ends of legs 50. 51.

Resonant beam 48 also has an enlarged force transmitting end 60 at the end of leg 51. Cutter blade 18 is mounted on a blade support 62 having an aft striking surface 64 in close proximity to force transmitting end 60 of resonant beam 48. As illustrated in FIG. 5, arms 66 depend from cross member 24 of the frame, and a pin connection 68 to blade support 62 limits the travel of cutter blade 18.

As is evident from FIG. 4, legs 50, 51 of resonant beam 48 have an included angle, directed toward mold board 16, of approximately 90 degrees. Extending inwardly between legs 50, 51 from central juncture 52 is a flange 70 having a pair of ears 71, 72. A mounting plate 74 is attached to the back side of mold board 16 by legs 76–78. Bolts 79, 80 rigidly attach ears 71. 72 to mounting plate 74 so that the central juncture 52, of resonant beam 48 is directly connected to mold board 16.

Figure 6:
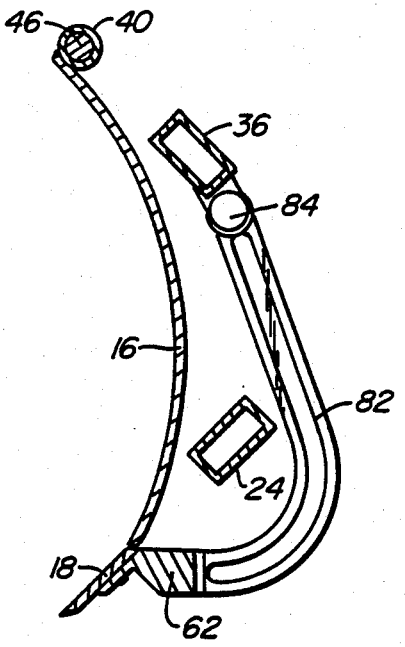
FIG. 6 is a section view taken along lines 6—6 of FIG. 3 and showing the suspension of the cutter blade.

As illustrated in FIG. 6, cutter blade 18 and blade support 62 are suspended on pivot arms 82. Pivot arms 82 are in turn pivotably supported by pin connection 84 to the upper box beam 36 of the frame. Cutter blade 18, as well as mold board 16 are thus independently pivotably suspended from the frame.

When motor 54 rotates universal shaft 56, the oscillator in the input end 53 of resonant beam 48 causes the beam to vibrate in near resonance. Force transmitting end 60 of resonant beam 48 strikes the back surface 64 of blade support 62, driving cutter blade 18 intermittently forwardly into the earth or other material to be moved to cut the material loose. The vibration of resonant beam 48 causes reciprocating forces to be established at node 52 along the axis of flange 70. These reciprocating forces are transmitted directly to mold board 16 to reciprocate the mold board about the pivotal support along its top edge.

Figure 7:
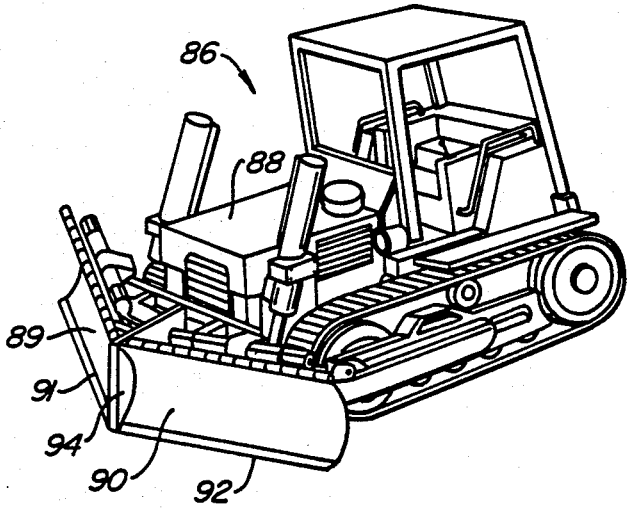
FIG. 7 is a perspective view of a second embodiment of the present invention in which the mold board has a pair of sections forming a V-shaped plow.

An alternative embodiment 86 of the bulldozer of the present invention is illustrated in FIG. 7. In this embodiment, a conventional tractor 88 similar to that illustrated in the first embodiment is used. However, in embodiment 86, the mold board consists of a pair of mold board sections 89. 90 with separate cutter blade sections 91. 92 at the respective lower edges. A plate 94 extends outwardly between mold board sections 89, 90 to form a plow having a V-shape. As in the first embodiment, mold board sections 89. 90 and cutter blade sections 91. 92 are suspended from a frame, and independently driven by angle beams to both cut the material loose and agitate the material so that it can be moved more readily.

While preferred embodiments of the present invention have been illustrated in detail, it is apparent that modifications and adaptations of the those embodiments will occur to those skilled in the art. For example, the construction illustrated could be adopted to earth moving machines similar to bulldozer, such as a front end loader. However, it is to be expressly understood that such modifications and adaptations are within the spirit and scope of the present invention, as set forth in the following claims.

What is claimed as new is:

1. In a bulldozer or like machine for moving earth and other material, said machine including a mold board, a reciprocating cutter blade along the lower edge of the mold board, a resonant beam mounted aft of the mold board having an input end, a central node and a force transmitting end proximate the cutter blade, and an oscillator at the input end for vibrating the resonant beam near its resonant frequency so that the force transmitting end drives the cutter blade intermittently forwardly into the material to be moved, the vibration of the beam resulting in a reciprocating force at the node thereof, the improvement comprising means for pivotably supporting the mold board so that the mold board is pivotable about a transverse axis, and means for connecting the resonant beam at its central node to the mold board so that the reciprocating transverse forces on the node of the resonant beam resulting from its near resonant vibration are transmitted to the mold board to agitate the material in contact with the mold board.

2. The machine of claim 1 wherein the resonant beam includes a juncture at the location of the central node and a pair of legs emanating from the juncture and having an included angle directed toward the mold board of less than 180 degrees.

3. The machine of claim 2 wherein the included angle between the pair of legs directed toward the mold board is approximately 90 degrees.

4. The machine of claim 2 wherein the beam includes a flange extending inwardly between the legs of the beam, and wherein the connecting means comprises means for attaching the flange to the mold board.

5. The machine of claim 4 wherein the back side of the mold board includes an mounting plate, and wherein the connecting means includes means for attaching the flange to the mounting plate.

6. The machine of claim 1 wherein the machine includes a tractor, and wherein the supporting means includes a rigid- frame coupled to the tractor and means for manipulating the position and inclination of the frame relative to the tractor.

7. The machine of claim 6 wherein the frame includes a plurality of vertical ribs, each rib having a forward edge conformed to the shape of the back surface of the mold board in close abutment therewith to restrict aft movement of the mold board about the pivotal support means.

8. The machine of claim 7 wherein the forward edge of each rib includes,, a pad conformed to the shape of the back surface of the mold board.

9. The machine of claim 1 wherein the mold board is pivotably supported proximate the top edge of the mold board.

10. A mold board assembly for a bulldozer tractor or like machine adapted to move earth and other material, said assembly comprising:

a frame coupled to the tractor and including at least one vertical rib and pivotal support means superimposed over the vertical rib;

a mold board having means proximate its upper edge for linking the mold board to the pivotal support means of the frame so that the mold board is pivotably supported at its upper edge by the frame with the back side of the mold board in close abutment with the rib to limit the pivotal movement of the mold board in the aft direction;

a resonant beam having a central juncture and a pair of legs emanating from the juncture;

means for vibrating the resonant beam at near its resonant frequency to generate reciprocating forces at the central juncture; and means for connecting the central juncture of the resonant beam to the aft side of the mold board so that the reciprocating forces are transmitted to the mold board to agitate the material in contact with the mold board.

11. The assembly of claim 10 and additionally comprising means for manipulating the position of the frame relative to the tractor.

12. The assembly of claim 10 wherein the frame includes a plurality of vertical ribs, each rib having a forward edge conformed to the shape of the back surface of the mold board in close abutment therewith to restrict aft movement of the mold board about the pivotal support means.

13. The assembly of claim 12 wherein the pivotal support means includes a plurality of cylindrical sleeves superimposed over the vertical ribs, and wherein the linking means comprises a plurality of complementary cylindrical sleeves along the top edge of the mold board, and a pin inserted through the complementary sleeves on the frame and the mold board to pivotably suspend the mold board from the frame.

14. The assembly of claim 13 wherein the forward edge of each rib includes a pad conformed to the back surface of the mold board.

15. The assembly of claim 10 wherein the pair of legs emanating from the juncture of the resonant beam have an included angle directed toward the mold board of less than 180 degrees.

16. The assembly of claim 15 wherein the included angle between the pair of legs directed toward the mold board is approximately 90 degrees.

17. The assembly of claim 10 wherein the beam includes a flange extending inwardly from the juncture between the legs of the beam, and wherein the connecting means comprises means for attaching the flange to the mold board.

18. The assembly of claim 17 wherein the back side of the mold board includes an mounting plate, and wherein the connecting means includes means for attaching the flange to the mounting plate.

19. The assembly of claim 10 wherein the resonant beam includes an input end at the distal end of one leg and a force transmitting end at the distal end of the other leg, and additionally comprising a cutter blade located at the lower edge of the mold board proximate the force transmitting end of the resonant beam, and means for mounting the cutter blade to allow for fore and aft reciprocal movement thereof so that the force transmitting end of the resonant beam intermittently strikes the cutter blade to drive it forwardly.

20. The assembly of claim 19 wherein the cutter blade mounting means includes a plurality of pivot arms suspended from the frame.

21. The machine of claim 10 and additionally comprising a pair of substantially identical resonant beams attached to the mold board.

22. The machine of claim 21 and wherein the mold board is split into a pair of sections forming a V-shape, at least one resonant beam being attached to each section of the mold board.

23. A bulldozer or like machine for moving earth and other material, said machine comprising:

a tractor:

a frame coupled to the tractor and having a plurality of vertical ribs, a plurality of cylindrical sleeves superimposed over the vertical ribs, each of the vertical ribs having a contoured vertical surface, and a plurality of suspended pivot arms;

a mold board having a plurality of cylindrical sleeves proximate its upper edge complementary to the sleeves of the frame;

a pin inserted through respective pairs of sleeves in the mold board and frame to pivotably mount the mold board to the frame;

a cutter blade mounted at the free ends of the pivot arms along the lower edge of the mold board;

a resonant beam having a central juncture, a pair of arms emanating from the central juncture at an included angle directed toward the mold board of less than 180 degrees, and a flange extending inwardly from the juncture between the leg to connect the resonant beam to the back side of the mold board, said resonant beam having an input end at the distal end of one of the legs and a force transmitting end proximate the cutter blade at the distal end of the other leg; and means at the input end of the resonant beam for vibrating the beam at near its resonant frequency so that the force transmitting end drives the cutter blade intermittently forwardly and the reciprocating forces at the central juncture are transmitted to the mold board to fluidize the material in contact with the mold board.

24. The machine of claim 23 wherein the included angle between the pair of legs directed toward the mold board is approximately 90 degrees.

25. The machine of claim 23 wherein the forward edge of each rib includes a pad conformed to the shape of the back surface of the mold board.

26. The machine of claim 23 wherein the vibrating means includes an oscillator at the input end of the beam, a motor having a rotary output, and a universal joint linking the motor to the oscillator.

27. The machine of claim 23 and additionally comprising a pair of substantially identical resonant beams attached to the mold board.

28. The machine of claim 27 and wherein the mold board is split into a pair of sections forming a V-shape, at least one resonant beam being attached to each section of the mold board.

* * * * *